US005782958A

United States Patent [19]

Rojey et al.

[11] Patent Number: 5,782,958

[45] Date of Patent: Jul. 21, 1998

[54] PROCESS FOR THE DEHYDRATION, DEACIDIFICATION AND STRIPPING OF A NATURAL GAS, UTILIZING A MIXTURE OF SOLVENTS

[75] Inventors: Alexandre Rojey; Etienne Lebas, both of Malmaison; Joseph Larue, Chambourcy; Ari Minkkinen, Saint Nom La Breteche, all of France

[73] Assignee: Institut Francais du Petrole, France

[21] Appl. No.: 777,442

[22] Filed: Dec. 30, 1996

[30] Foreign Application Priority Data

Dec. 28, 1995 [FR] France ..... 95 15626

[51] Int. Cl.[6] ..... B01D 3/26

[52] U.S. Cl. ..... 95/192; 48/198.3; 62/625; 62/635; 95/193; 95/208; 95/209; 95/235; 95/236; 95/237

[58] Field of Search ..... 95/187, 188, 192, 95/193, 208, 209, 230, 228, 235–240; 62/625, 632, 635, 929; 48/198.3

[56] References Cited

U.S. PATENT DOCUMENTS

| | | | |
|---|---|---|---|
| 3,899,312 | 8/1975 | Kruis et al. | 62/625 |
| 4,368,059 | 1/1983 | Doerges et al. | 95/237 X |
| 4,606,741 | 8/1986 | Moreau et al. | 95/49 |
| 4,617,038 | 10/1986 | Mehra | 62/635 |
| 4,675,035 | 6/1987 | Apffel | 62/929 X |
| 4,702,750 | 10/1987 | Becker | 95/236 X |
| 4,861,360 | 8/1989 | Apffel | 62/625 |
| 4,999,031 | 3/1991 | Gerhardt et al. | 95/236 X |
| 5,298,156 | 3/1994 | Blanc et al. | 95/237 X |

FOREIGN PATENT DOCUMENTS

| | | |
|---|---|---|
| 2 600 554 | 12/1987 | France . |
| 1 794 353 | 2/1973 | Germany . |

*Primary Examiner*—Richard L. Chiesa
*Attorney, Agent, or Firm*—Millen, White, Zelano & Branigan, P.C.

[57] ABSTRACT

A process for the dehydration, deacidification and stripping of a gas, characterized in that:

(a) at least one fraction of the gas is contacted with an aqueous phase containing methanol, the resultant gas being thus charged with methanol being withdrawn from stage (a);

(b) the gas withdrawn from stage (a) is contacted with a mixture of solvents comprising methanol, water, and a solvent heavier than methanol, the gas leaving stage (b) being thus at least in part freed of the acid gases which it contained initially;

(c) the mixture of solvent obtained from stage (b) is at least in part generated by special reduction and/or heating while liberating at least part of the acid gases, the mixture of solvent being at least partially regenerated, or being at the outlet of stage (c) recycled through stage (b); and (d) the gas obtained from (stage b) is refrigerated while producing at least an aqueous phase containing methanol which is at least in part recycled through stage (a).

19 Claims, 3 Drawing Sheets

1
2
3
4
5
6
7
8
9
10
11
12
13
14
15
23
40
41
42
43
C1
C2
B1
B2
B20
D1
E1
E2
E3
E4
E5
V1
V2
V40
P1
P2
P12

PROCESS FOR THE DEHYDRATION, DEACIDIFICATION AND STRIPPING OF A NATURAL GAS, UTILIZING A MIXTURE OF SOLVENTS

BACKGROUND OF THE INVENTION

The invention relates to a process for dehydration and/or stripping of natural gas, using a mixture of solvents.

The treatment of a natural gas requires dehydration and stripping when the natural gas contains condensable hydrocarbons, and requires deacidification of this gas when the proportion of acid gases therein is too high.

It is possible to dehydrate and to strip a gas such as a natural gas by refrigerating (cooling) it in the presence of methanol to keep ice and/or hydrates from forming.

It has been found, and this is one of the objects of this invention, that since the gas is charged with methanol, it is possible to carry out a deacidification stage prior to the refrigeration stage under advantageous conditions by using a mixture of solvents that contains methanol to carry out said deacidification stage.

It has also been found that it is then possible to limit the coabsorption of hydrocarbons by using a mixture of solvents comprising water, methanol, and a heavier solvent than methanol.

This invention also makes it possible to recover the methanol contained in the gas by a simple and economical means.

Various heavy solvents can be used in the process according to the invention. The heavy solvent can be, for example, a polar solvent such as dimethylformamide (DMF), N-methylpyrrolidone (NMP), or dimethyl sulfoxide (DMSO). The heavy solvent can also be a chemical solvent such as, for example, a secondary or tertiary amine, for example, a hydroxylated amine.

It is thus possible to combine the advantages of an amine as a chemical solvent and of methanol as a physical solvent. The presence of methanol makes it possible in particular to reduce very appreciably the ratio of solvent for relatively large contents of acid gases in the gas to be treated. The presence of methanol also makes it possible to absorb and separate from the gas to be treated such impurities as, for example, mercaptans, carbonyl sulfide (COS), and carbon disulfide ($CS_2$).

It is also possible in the process according to the invention to use solvent mixture fractions of various compositions to optimize the conditions under which the gas is scrubbed with the mixture of solvents.

The process of the invention can be defined in a general manner by the fact that it comprises the following stages:

(a) at least one fraction of the gas is brought into contact with an aqueous phase that contains methanol, with the gas thus being charged with methanol at the output of stage (a);

(b) the gas exiting stage (a) is brought into contact with a mixture of solvents that comprises methanol, water, and a heavier solvent than methanol, with at least a portion of the gas exiting stage (b) thus being at least partially freed of the acid gases that it initially contained in the process;

(c) at least a portion of the mixture of solvents that is obtained from stage (b) that is charged with acid gases is regenerated by pressure reduction and/or heating by releasing at least a portion of the acid gases, with the mixture of solvents that is at least partially regenerated being, at the end of stage (c), recycled to stage (b); and (d) the gas that is obtained from stage (b) is cooled sufficiently to produce an aqueous phase that contains methanol which is recycled at least in part to stage (a).

DETAILED DESCRIPTION OF THE DRAWINGS

Figure 1:
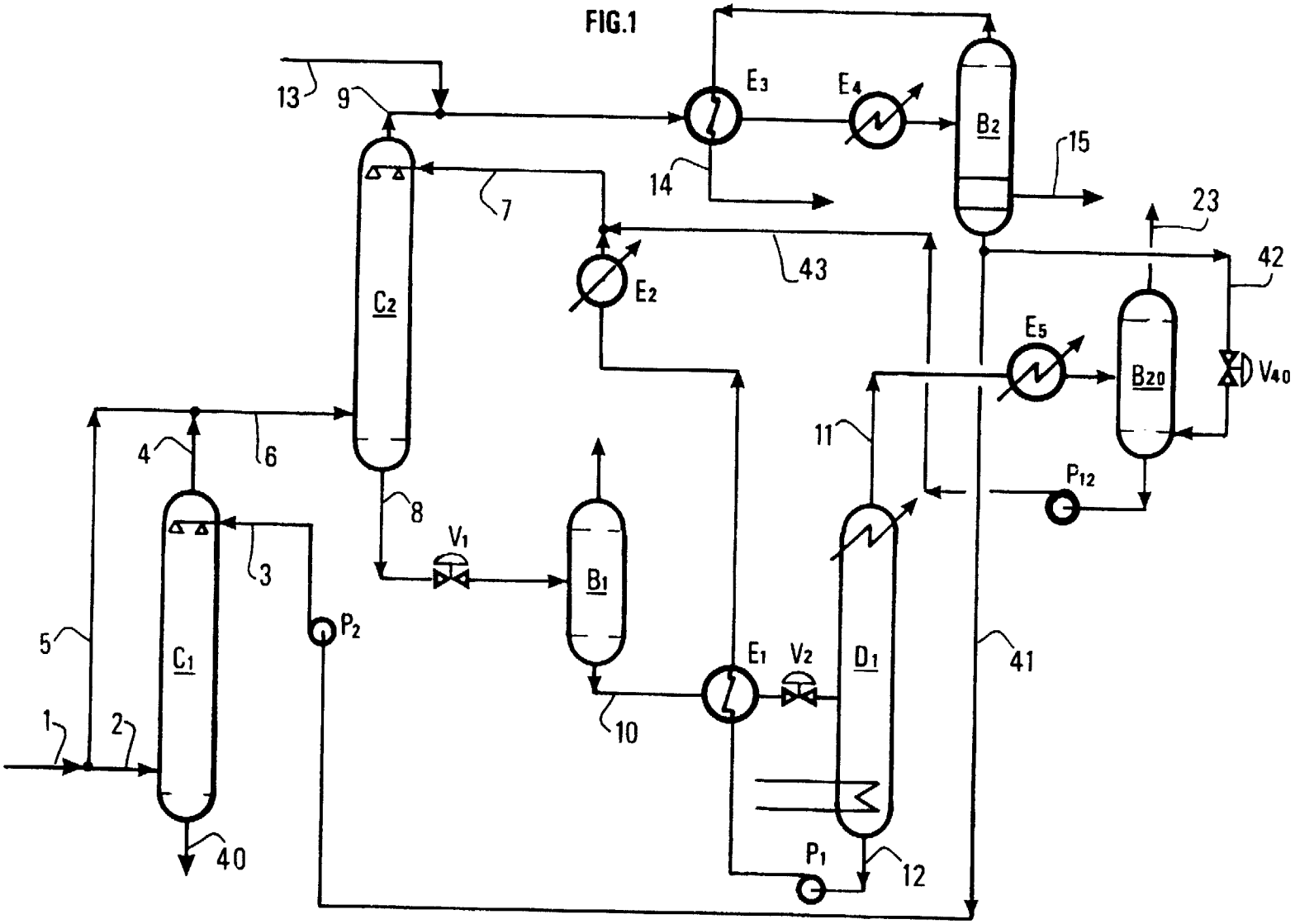
FIGS. 1–6 are schematic flowsheets of preferred embodiments of the invention.

The process according to the invention is described in more detail below in connection with the diagram in FIG. 1.

The gas to be treated comes in through pipe 1. It contains, for example, methane, ethane, propane, butane, as well as heavier hydrocarbons, water, and acid gases such as, for example, $H_2S$ and $CO_2$.

One fraction of this gas is sent via pipe 2 into contact column C1, where it is brought into countercurrent contact with a methanol solution in the water that is coming in through pipe 3. At the bottom of column C1, an aqueous phase that is largely free of methanol is eliminated via pipe 40. At the top of column C1, a gas that is charged with methanol is recovered via pipe A and is mixed with a fraction of gas that has not gone through column C1. The gas that is thus obtained constitutes the gas that is charged with methanol coming from stage (a). This gas is then sent via pipe 6 into column C2, where it is brought into contact with a mixture of solvents that comprises methanol, water, and a heavier solvent than methanol, which comes in through pipe 7. This mixture of solvents emerges via pipe 8 charged with acid gases, while at least a portion of the gas that is evacuated at the top of the column via pipe 9 is free of the acid gases that it initially contains in column C2 (stage (b)).

The pressure of the mixture of solvents that is obtained from this stage (b) is first reduced to an intermediate pressure through pressure reducing valve V1 by releasing a gas phase that contains at least a portion of the hydrocarbons which have been able to be co-absorbed in the solvent mixture. The gas phase and the liquid phase that are thus obtained are separated in balloon B1.

The makeup flow rate of aqueous phase thus provided can be controlled by, for example, a mixture of solvents in a collection or storage vessel that is located, for example, at the outlet of column D1.

The gas phase is evacuated at the top of balloon phase separator vessel B1. The residual solvent mixture is evacuated via pipe 10 and passes through exchanger E1, where it is reheated. It is then released through valve V2 and regenerated in distillation column D1. This column is cooled at the top, which makes it possible to evacuate via pipe 11 acid gases that are relatively slightly charged with solvent, and the column is also heated at the bottom, which makes it possible to evacuate via pipe 12 a mixture of solvents that is largely free of acid gases. The acid gases that are evacuated via pipe 11 undergo an additional refrigeration step in exchanger E5 to recover at least a portion of the residual methanol. The liquid phase that is thus obtained is collected in balloon-separator B20, which also receives the aqueous phase input that comes in through pipe 42 and goes through pressure reducing valve V40. The liquid phase that is thus collected in balloon-separator B20 is recycled via pump P12 through pipe 43 to the top of column C2. The mixture of solvents that is evacuated via pipe 12 is sent back via pump P1 and sent through exchanger E1, where it is cooled by reheating the mixture of solvents which comes in through pipe 10. It is then cooled in exchanger E2 by exchange with water or cooling air and recycled to column C2.

If the temperature at the top of column C2 is higher than the temperature at the bottom, as a result of the absorption heat released, the gas that leaves column C2 via pipe 9 carries a larger amount of water than that which comes in through pipe 6. Likewise, a certain amount of water can be evacuated with the acid gases via pipe 11. To offset these losses of water from the circuit of the solvent mixture, it is necessary in this case to provide an aqueous phase makeup. This aqueous phase makeup can be obtained, for example, by cooling the gas at the outlet of column C2 and by returning the condensed fraction to the circuit of the solvent mixture. It is also possible, as is shown in FIG. 1, to remove a fraction of the aqueous phase collected in balloon-separator B2 and to recycle it via pipe 42 and through pressure reducing valve V40 to the circuit of the solvent mixture.

The regeneration of the solvent which constitutes stage (c) of the process can also be carried out according to various arrangements, which will be described below.

The gas that is obtained from stage (b) which is evacuated via pipe 9 receives a makeup portion of methanol that comes in via pipe 13. It is then cooled, first by internal exchange in exchanger E3 and then by exchange with an external refrigeration fluid that is obtained from a refrigeration circuit, in exchanger E4. This refrigeration makes it possible to condense a methanol solution and a liquid hydrocarbon phase. The gas phase that is thus obtained constitutes the treated gas which is largely free of the water, acid gases, and heavy hydrocarbons that it contains initially. The three-phase mixture that is obtained is separated in balloon B2. The treated gas passes through exchanger E3, where it is reheated by cooling the gas which comes in from column C2, and it is evacuated via pipe 14.

The liquid hydrocarbon phase that is obtained is evacuated via pipe 15, and the fraction of the aqueous phase that contains the methanol that is obtained, which is not evacuated via pipe 42, is recycled via pump P2 through pipe 41 to column C1.

The mixture of solvents that is sent via pipe 7 comprises methanol, water, and a heavier solvent than methanol.

The methanol content of the gas that is evacuated via pipe 9 should be high enough to prevent the formation of ice and/or hydrates during the refrigeration stage, with the makeup portion of methanol that comes in through pipe 13 being reduced and intended to offset the losses. This means that this methanol content is higher, the lower the refrigeration temperature at the outlet of exchanger E4. The methanol content in the mixture of solvents that comes in through pipe 7 is also higher, the lower the temperature at which the gas is refrigerated.

The methanol content can be easily regulated by the makeup portion of methanol that comes in through pipe 13. The amount of the makeup portion is, for example, tied to the methanol content in the aqueous phase that is collected in separator B2 to reach the required content to keep hydrates from forming.

In this case, the methanol content in the solvent mixture can be, for example, between 5 and 50 mol %.

The heavy solvent that is a part of the composition of the mixture of solvents can be a polar solvent, such as, for example, DMF, NMP, DMSO, as described above; it may also be sulfolane, propylene carbonate, a heavier alcohol than methanol, an ether, or a ketone. The main condition to be met is that its boiling point must be greater than the boiling point of the methanol and preferably greater than the boiling point of water. It is also necessary that this solvent be at least partially miscible with water and methanol.

In this case, the content of heavy solvent in the mixture of solvents can be, for example, between 10 and 60 mol %.

The water content forms the addition, but it is preferably at least equal to 10 mol %.

The heavy solvent that is part of the composition of the solvent mixture can also be a chemical type of solvent, such as, for example, a secondary or tertiary amine, generally a hydroxylated amine, that is selected, for example, from among monoethanolamine, diethanolamine, diglycolamine, diisopropanolamine, and methyldiethanolamine.

The amine content in the solvent mixture can be, for example, between 1 and 10 mol %.

The heavy solvent is selected in accordance with the specifications required for treated gas. If selective deacidification is desired, which consists in eliminating $H_2S$ much more selectively than $CO_2$, a selective amine, such as, for example, methyldiethanolamine, will be used.

It is also possible to use a mixture of heavy solvents to optimize the characteristics of the mixture of solvents.

It is also possible to add additives that are known to one skilled in the art, such as, for example, additives that make it possible to activate the absorption of $CO_2$ or additives that act as corrosion inhibitors, or else additives that act as anti-foaming agents. It can also be advantageous to filter the mixture of solvents that is sent to column C2 to stop the solid particles which can promote foaming.

The countercurrent contact in column C1 that works in between at least a portion of the gas to be treated and the aqueous phase that contains methanol that is obtained from stage (d) makes it possible to evacuate at the bottom of said column an aqueous phase that is largely free of methanol. This makes it possible to easily recover and recycle the methanol and to avoid any pollution that is connected to the presence of methanol in the released aqueous phase.

The contact column used can be of various types known to one skilled in the art: a plate column or a packed column. In the case of a packed column, it can be advantageous to use a structured packing.

Likewise, the other columns that are used in the process, particularly C2 and D1 that are used during stages (b) and (c), can be of various types that are known to one skilled in the art: a plate column or a packed column, and in particular a packed column with structured packing.

EXAMPLE

The following numerical example illustrates the operation of the process according to the invention.

This example of use of the process according to the invention is described in connection with FIG. 1.

The composition of the natural gas is, for example, the following (in kg/h):

| | |
|---|---|
| Water | 60.55 |
| nitrogen | 782.37 |
| carbon dioxide | 8770.15 |
| methane | 31699.87 |
| ethane | 5210.67 |
| propane | 3088.88 |
| isobutane | 625.43 |
| N-butane | 1024.58 |
| isopentane | 330.39 |
| N-pentane | 297.37 |
| N-hexane | 118.29 |
| N-heptane | 343.99 |
| Total | 52352.54 |

The gas to be treated comes in through pipe 1 at a temperature of 30° C. and at a pressure of 70 bar at a flow rate that is approximately equal to 52.352 kg/h. A fraction of this gas (50%) is injected into contact column C1 via pipe 2.

A solution that contains 65% by weight of methanol in water, at a flow rate of 159 kg/h and at a temperature of 30° C., is injected countercurrently into column C1 via pipe 3. At the bottom of column C1, an aqueous phase that contains 12 ppm by weight of methanol at a flow rate of 60 kg/h is withdrawn via pipe 40. At the top of column C1, the gas that is charged with methanol is evacuated via pipe 4 and mixed with the gas which has not passed through column C1 and which comes in via pipe 5.

The gas that is thus obtained is sent via pipe 6 into column C2. A solution that contains 20% by weight of methanol and 20% by weight of diethanolamine in water is injected countercurrently into column C2 via pipe 7 at a temperature of 40° C. and at a flow rate of 117,409 kg/h. At the bottom of column C2, the mixture of solvents that is charged with carbon dioxide is recovered via pipe 8 at a temperature of 46° C.

The gas that is evacuated at the top of column C2 via pipe 9 does not contain more than 1.8% by weight of carbon dioxide. This gas is cooled in exchangers E3 and E4 to a temperature of −26° C. The three-phase mixture that is obtained is separated in balloon B2. The treated gas, which is evacuated via pipe 14, has a flow rate of 44,889 kg/h. The liquid hydrocarbon phase that is obtained is evacuated via pipe 15. The aqueous phase that contains methanol is partially recycled into column C1 via pipe 41, with the other portion (75%) being sent into balloon B20.

The mixture of solvents that is charged with carbon dioxide is released at a pressure of 10 bar via pressure reducing valve V1 and then sent into balloon-separator B1. The liquid phase that comes from balloon B1 is sent via pipe 10 into exchanger E1, where it is reheated to a temperature of 60° C. It is then released at a pressure of 1.5 bar and injected into distillation column D1. This column is cooled at the top to a temperature of 40° C. and heated at the bottom. The mixture of solvents that is recovered via pipe 12 at a temperature of about 80° C. is sent back via pump P1 and then is cooled in exchangers E1 and E2 before being recycled in column C2.

The gas that is evacuated at the top of column D1 via pipe 11 is cooled to −26° C. after it passes into exchanger E5. Balloon B20 makes it possible to separate a liquid phase that contains basically methanol and water and a gas phase that contains basically carbon dioxide. The aqueous phase is recycled into column C2 via pipe 43. The gas phase is evacuated via pipe 23.

In the process according to the invention, it may be advantageous, in order to optimize the performance levels of the process, to carry out stage (b) by bringing the gas successively into contact with fractions of solvent mixtures of various compositions. If one mixture fraction is sent to the top and another to an intermediate point, it is advantageous to send to the top a fraction of the solvent mixture that is relatively low in methanol and to send to an intermediate point a fraction of the solvent mixture that is relatively rich in methanol.

An example of such an embodiment is described in connection with the diagram in FIG. 2.

Column 1 is operated as in the case of the example that is described in connection with FIG. 1.

The gas that is charged with methanol comes in through pipe 6 into column C2. It is first brought into contact in a first zone (lower portion) of column C2 with a fraction of the solvent mixture that is relatively rich in methanol that is introduced via pipe 16. The methanol content in this first fraction of the solvent mixture can be, for example, between 20 and 70 mol %.

The gas is then brought into contact in a second zone (upper portion) of column C2 with a fraction of the solvent mixture that is relatively low in methanol and that is introduced via pipe 7. The methanol content in this second fraction of the solvent mixture can be between, for example, 5 and 30 mol %. This methanol content should be higher than the methanol content in the gas exiting via pipe 9 is high, i.e., higher, the lower the temperature at the outlet of exchanger E4 to keep ice and/or hydrates from forming.

The mixture of solvents that is obtained from stage (b), i.e., in the case of the example that is described in connection with FIG. 2*a* exiting column C2 via pipe 8, is regenerated by expansion and then by heating in a countercurrent manner in a contact column D1, with the solvent phase removed at the bottom of said column forming the fraction of the solvent mixture that is relatively low in methanol which is injected at the top of the contact column that is used during stage (b), i.e., column C2 in the case of the example that is described in connection with FIG. 2*a*.

In this embodiment, the mixture of solvents that is charged with acid gases exiting via pipe 8 is first released at an intermediate pressure level through valve V1, by releasing a gas phase which contains at least one portion of hydrocarbons which have been able to be coabsorbed in the mixture of solvents. This gas phase can be washed by a fraction of the solvent mixture which is relatively low in methanol, whose flow rate is controlled by distribution valve V30 and which is sent via pipe 17 to the top of a contact section countercurrent located in column element C10. The gas which exits at the top of column element C10 is thus largely free of the acid gases that it contained and can be used as, for example, burnable gas or else be recompressed and mixed with the treated gas.

This arrangement is not limited to the sample embodiment that is described in connection with FIG. 2.

Thus, even for other embodiments, it is possible to subject a mixture of solvents that is obtained from stage (b), a first expansion stage, to intermediate pressure to release at least a portion of the coabsorbed hydrocarbons.

As in the case of other embodiments, it is also possible to wash the gas fraction that is obtained from the reduction of pressure to an intermediate pressure of the solvent mixture coming from stage (b), with a fraction of the mixture of solvents that is relatively low in methanol which is collected at the bottom of the regeneration column that is used during stage (c).

At the outlet of column element C10, the pressure of the mixture of solvents is reduced in turn to low pressure, for example, a pressure that is close to atmospheric pressure, through pressure reducing valve V20. The liquid-vapor mixture that is thus obtained is separated in balloon-separator B10. The vapor phase, which is composed basically of acid gases and methane, is evacuated via pipe 18. The liquid phase that is thus obtained is divided into two fractions. A first fraction, preferably having the higher flow rate, is sent back via pump P11 through pipe 20 and forms the majority of the fraction of the mixture of solvents that is relatively rich in methanol which is sent via pipe 16 to an intermediate point of column C2.

A second fraction of the mixture of solvents that is obtained at the outlet of balloon-separator B10 is reheated in exchanger E1, by heat exchange with the mixture of solvents that is obtained from the bottom of column D1 and is then sent into distillation column D1. A vapor reflux is generated at the bottom of column D1 with reboiler R1, and a liquid reflux is generated at the top of column D1 with condenser E6.

The gas phase which results from the partial condensation in E6 and is evacuated at the top via pipe 19 is composed basically of acid gases and methanol.

In this embodiment, said gas phase is mixed with the gas phase that is evacuated via pipe 18, and the gas mixture that is thus obtained is refrigerated in exchanger E5. The liquid-vapor mixture that is thus obtained is separated in balloon-separator B20. A makeup of aqueous phase feeds balloon B20 through pipe 42 and through pressure reducing valve V40. The gas phase, which is composed basically of separate acid gases, is evacuated via pipe 23. The liquid phase that is rich in methanol is sent back via pump P12 through pipe 22 and, after mixing with the fraction that comes in through pipe 20, forms the fraction of the mixture of solvents which is sent to an intermediate point of column C2.

The liquid phase which is evacuated at the bottom of column D1 becomes low in methanol. In column D1, stripping at the bottom of the column is ensured by a methanol-rich vapor, which makes it possible to ensure the reboiling of column D1 at a lower temperature by providing less heat than with no methanol.

The liquid phase that is evacuated at the bottom of column D1 is sent back via pump P10. It is cooled in exchanger E1, from which it emerges via pipe 21. It is then divided into two fractions by means of distribution valve V30. A first fraction, with the higher flow rate, is cooled in exchanger E2 by water or cooling air and sent to the top of column C2 via pipe 7. A second fraction is sent via pipe 17 to the top of column element C10.

Various other arrangements can be used without exceeding the scope of the invention.

When the gas to be treated contains a large proportion of $CO_2$ and $H_2S$, there may be a desire to obtain separate fractions of acid gases that are rich in, respectively, $CO_2$ and in $H_2S$.

Figure 3:
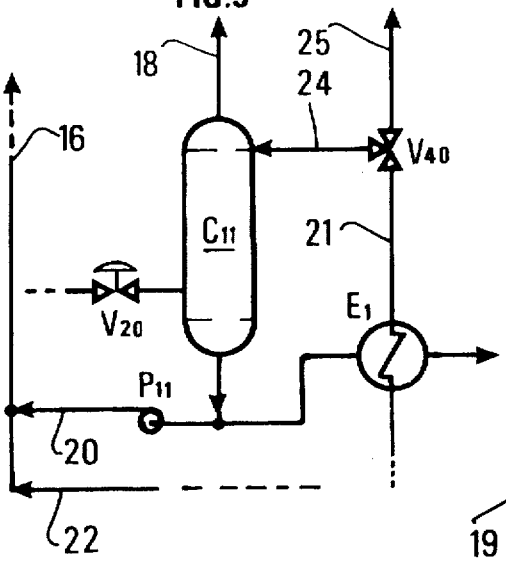

In this case, it is possible to operate, for example, according to the arrangement of FIG. 3, in which only one portion of the device appears. The gas fraction that is relatively rich in $CO_2$, which is obtained at the end of the reduction of the pressure of the mixture of solvents though pressure reducing valve V20, is sent into column element C11, where it is brought into contact with a portion of the mixture of solvents that is relatively low in methanol that comes in through pipe 21, to eliminate selectively the $H_2S$ that is present in the gas. The mixture of solvents that comes in through pipe 21 is divided into two fractions by passage through distribution valve V40. A first fraction is sent via pipe 24 to the top of column element C11. A second fraction is sent via pipe 25 to the top of column C2. The mixture of solvents that is collected at the bottom of column element C11 and that comes in through pump P11 and pipe 20 is mixed with the liquid fraction that comes in through pipe 22. The resulting mixture of solvents is sent to an intermediate point of column C2.

In this case, the gas fractions that are evacuated via pipes 18 and 19 that constitute, respectively, the fractions that are rich in $CO_2$ and in $H_2S$ are not mixed and can undergo separately an additional treatment, for example, by refrigeration, to eliminate at least a portion of the methanol carried with the acid gases.

Figure 4:
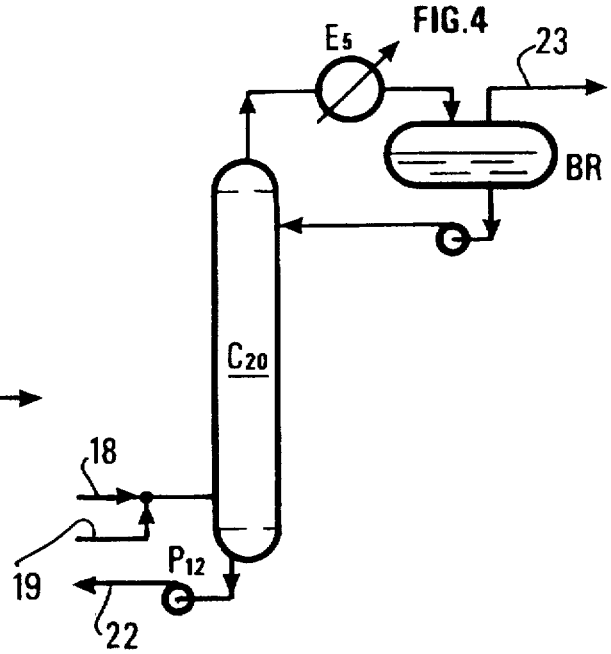

Another arrangement which may be used consists, instead of refrigerating immediately the acid gases that come in through pipe 18, via pipe 19 or after mixing these two fractions, in sending these acid gases into a rectification column element according to the sample arrangement shown in FIG. 4.

The acid gases that contain methanol and that are obtained by mixing the gas fractions that come in through pipes 18 and 19 are sent to column element C20. The gas fraction at the top of column element C20 is refrigerated in exchanger E5. The liquid-vapor mixture that is thus obtained is separated in reflux balloon BR. The gas phase that is rich in acid gases is evacuated via pipe 23. The liquid phase is sent as reflux to the top of column element C20. At the bottom of column element C20, a liquid phase that is rich in methanol is obtained, which is sent back via pump P12 and sent through pipe 22.

It is also possible to eliminate at least a portion of the methanol that is carried in the acid gases by washing these acid gases with the water that is obtained from stage (a), i.e., in the embodiments that are described in connection with FIGS. 1 and 2, collected at the bottom of column C1, with the aqueous phase containing methanol that is thus obtained being sent back to stage (a), i.e., in the embodiments that are described in relation to FIGS. 1 and 2 at the top of column C1.

To send a fraction of the mixture of solvents that is relatively rich in methanol and better purified of acid gases to an intermediate point of contact column C2 used during stage (b), it is possible to send the entire mixture of cooling agents coming from stage (b) to regeneration column D1 that is used during stage (c) and to remove the fraction of the mixture of solvents that is relatively rich in methanol, which is sent to an intermediate point of contact column C2 used during stage (b), at an intermediate point of regeneration column D1.

Figure 5:
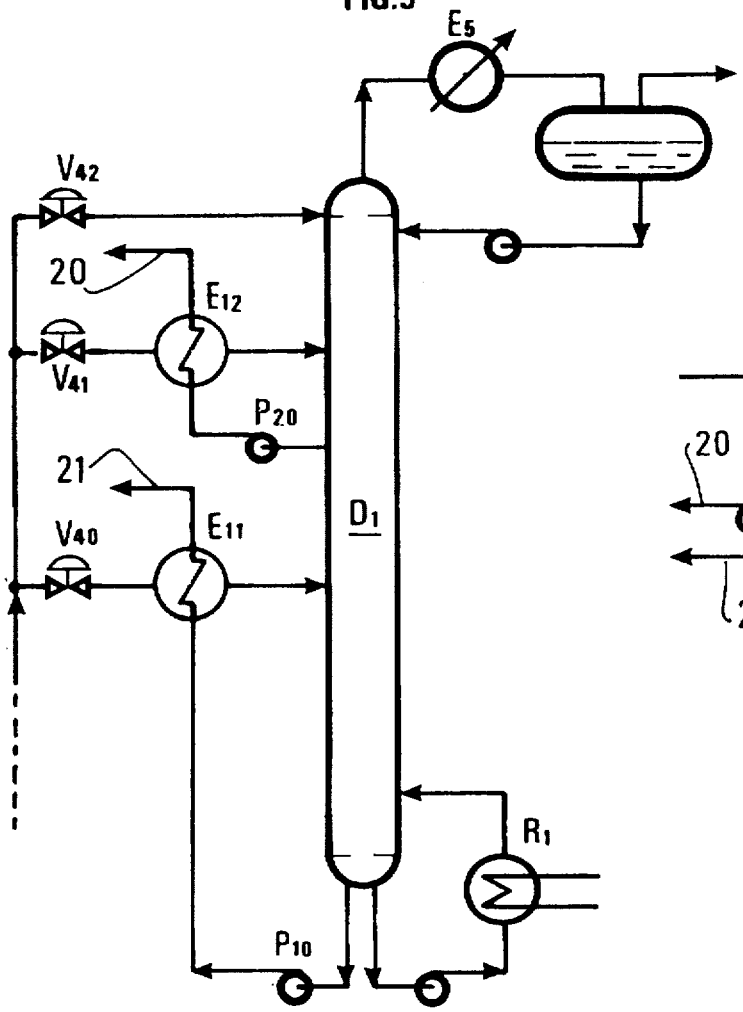

Such an embodiment is illustrated by the diagram of FIG. 5.

Figure 2:
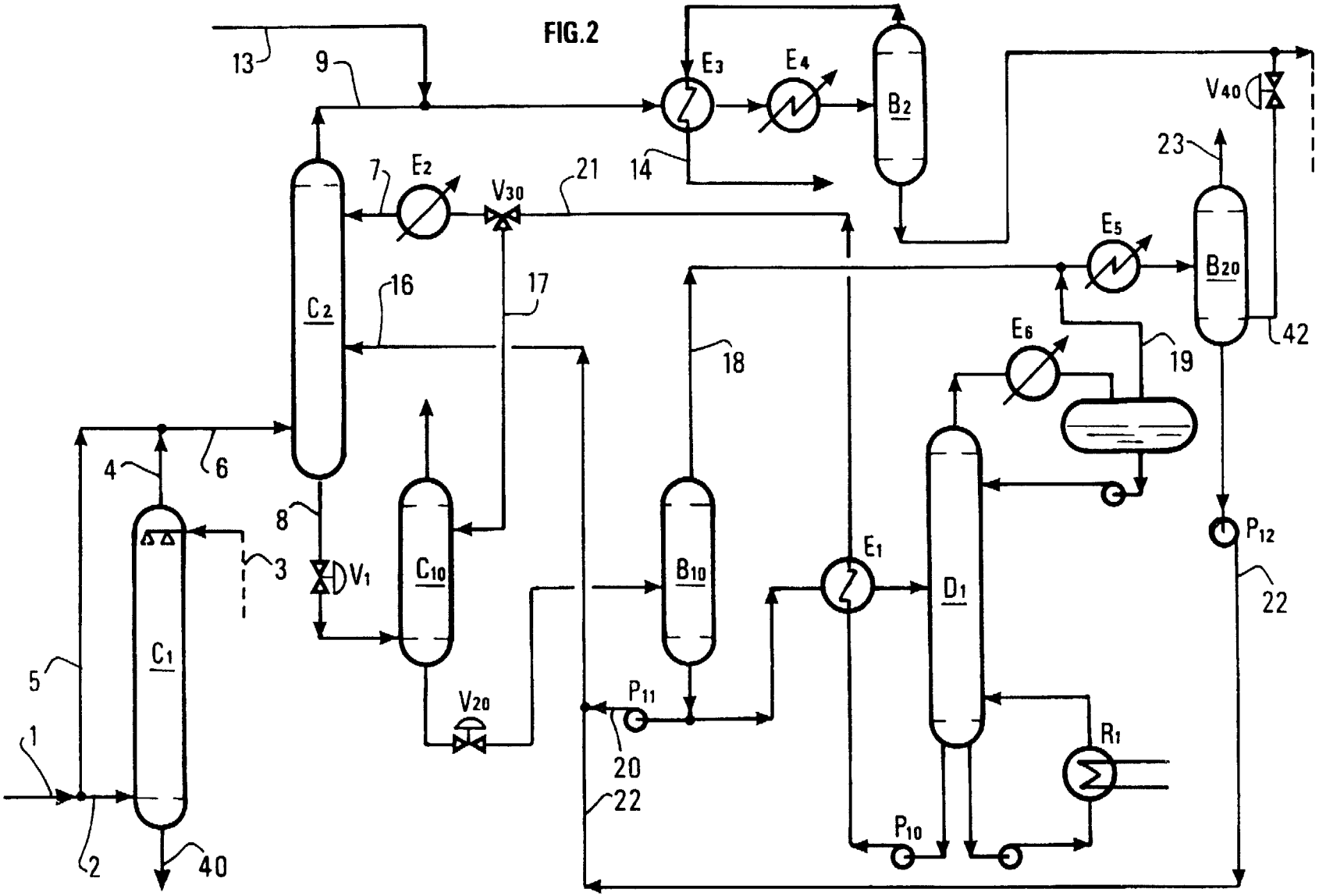

The mixture of solvents that is charged with acid gases and that is obtained from the bottom of column element C10 that is shown in FIG. 2 is divided into three fractions.

The pressure of a first fraction is reduced through valve V42 and sent to the top of column D1.

The pressure of a second fraction is reduced through valve V41 and then is reheated in exchanger E12 by heat exchange with the fraction of the mixture of solvents that is relatively rich in methanol and which is removed at a point that is located below the feed point and sent via pump P20 into exchanger E12 from which it comes out via pipe 20 to form at least a portion of the fraction of the mixture of solvents which is sent to an intermediate point of column C2.

The pressure of the third fraction is reduced through valve V40 and is then reheated in exchanger E11 by heat exchange with the fraction of the mixture of solvents which is relatively low in methanol and which is collected at the bottom of regeneration column D1 and sent via pump P10 into heat exchanger E11, from which it comes out via pipe 21 to form at least a portion of the fraction of the mixture of solvents which is sent to the top of column C2.

This embodiment of the process is therefore characterized in that the fraction of the mixture of solvents that is relatively rich in methanol which is sent to an intermediate point of the contact column used during stage (b) is removed at an intermediate point of the regeneration column used during stage (c).

In the embodiments that are described in relation to FIGS. 2 to 5, the procedure is carried out with two fractions of the mixture of solvents of different compositions which are sent to two different levels of column C2.

Each of these fractions can be sent to several different levels. Likewise, it is possible to use more than two fractions of different compositions, with said fractions being removed at different points of regeneration column D1 used during stage (c) and sent to different points on absorption column C2 used during stage (b).

The fraction or fractions of the mixture of solvents that is (are) obtained from regeneration column D1 is (are) cooled to a temperature that is close to the temperature at which stage (b) is carried out by heat exchange with one or more fractions of the mixture of solvents that comes from stage (b) and optionally by an additional heat exchange step with a cooling fluid such as water or air.

Absorption stage (b) is carried out in column C2 at a temperature of between, for example, +10° and +40° C., but it is also possible to reduce the solvent ratio to carry out this stage at lower temperatures, with a mixture of solvents that is selected so as not to become too viscous at these temperature levels.

The pressure at which the absorption stage is carried out in column C2 can be between several bar and more than one hundred bar. It can be, for example, close to 70 bar.

During stage (c), the natural gas can be refrigerated at a temperature of up to, for example, between 0° and −100° C., with the methanol content in the fraction of the mixture of solvents that is sent to the top of the contact column that is used during stage (b) being adjusted to obtain a methanol content in the gas coming from stage (b) that makes it possible to keep hydrates from forming at the lowest temperature obtained during stage (c).

When the gas contains condensable hydrocarbons, the refrigeration that is carried out during stage (c) makes it possible to strip this gas and to adjust the hydrocarbon dewpoint to the value that is required for the transport of the gas.

This refrigeration can also make it possible to fractionate this gas by separating, for example, the LPGs that are present in the gas. It is possible in this case to use all the devices that are known to one skilled in the art, such as, for example, distillation columns or heat exchangers that operate with liquid reflux.

At least a portion of the mixture of solvents that is obtained from stage (b) can be regenerated after pressure reduction in a device that operates by simultaneous fractionation and heat exchange.

Figure 6:
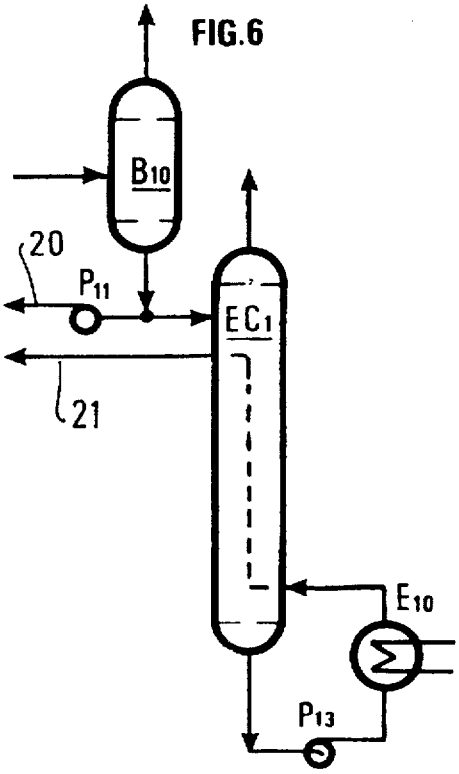

Such an arrangement is illustrated by the embodiment that is shown in the diagram of FIG. 6.

With the pressure of the mixture of solvents coming from absorption stage (b) being reduced to the low pressure at which regeneration stage (c) is carried out, a liquid-vapor mixture is obtained which is separated in balloon-separator B10. A liquid fraction of the partially regenerated mixture of solvents is removed via pump P11 to feed the absorption column, which is carried out in stage (b) at an intermediate point. The remaining fraction is sent into device EC1, where it is brought into contact with a gas reflux while exchanging heat with the liquid fraction of the mixture of solvents exiting exchanger EC1 and sent via pump P13 into exchanger E10 where it is heated by an external fluid.

Device EC1 can be, for example, a heat exchanger that is arranged vertically and operates in countercurrent. The mixture of solvents that comes in from balloon-separator B10 is sent to the top of this exchanger. It is gradually heated by dropping in the exchanger, which leads to the formation of a gas phase that contains basically acid gases and methanol which is evacuated at the top via pipe 19, by circulating in exchanger EC1 in countercurrent with the liquid phase that consists of the mixture of solvents.

Thus purified, the mixture of solvents exits at the bottom of exchanger EC1. It is sent back via pump P13, heated in exchanger E10, and cooled by passing through exchanger EC1 where it heats the mixture that drops. At the output of exchanger EC1, the purified mixture of solvents is sent via pipe 21 to the top of absorption column C2 that is used during stage (b).

Exchanger EC1 can have, for example, pipes and a calandria or else plates made of either brazed aluminum or stainless steel.

The regeneration stage can be carried out in two or more columns that operate under different conditions of pressure and temperature. It is thus possible to obtain, for example, acid gas fractions of different compositions, for example, a fraction that is concentrated in $CO_2$ and a fraction that is concentrated in $H_2S$.

As has already been indicated, it is necessary in this case to use a solvent that is selective for $H_2S$ as a heavy solvent. During a first regeneration operation, the $CO_2$ that is contained in the mixture of solvents is then separated. As already indicated, if the acid gases that are obtained during this first regeneration operation contain $H_2S$, the latter can be eliminated by washing in countercurrent with a fraction of the mixture of solvents. The $H_2S$ is then separated from the mixture of solvents during a second regeneration operation.

Each of these regeneration operations can be carried out in one or more distillation sections; some of them can be carried out with simultaneous heat exchange.

Regeneration stage (c) thus comprises at least two successive regeneration operations, with a gas fraction that is rich in $CO_2$ being obtained at the end of the first operation and a gas fraction that is rich in $H_2S$ being obtained at the end of the second operation.

As has been indicated, the process also makes it possible to separate impurities such as mercaptans, COS, and $CS_2$, which can be eliminated with, for example, the gas fraction that is rich in $H_2S$.

The preceding examples can be repeated with similar success by substituting the generically or specifically described reactants and/or operating conditions of this invention for those used in the preceding examples.

The entire disclosure of all applications, patents and publications, cited above and below, and of corresponding French application 95/15626, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

In the specification and claims, the term "heavy" and "heavier" in relationship to solvents is used interchangeably to mean higher boiling than methanol unless otherwise specified. Also, the term "balloon" is synonymous with "vessel," "disked vessel," "tank," "gas holder" as appropriate within the context of the description of the invention.

What is claimed:

1. A process for dehydration and/or deacidification and/or stripping of a gas that is characterized in that:

(a) at least one fraction of the gas is brought into contact with an aqueous phase that contains methanol, with the gas thus being charged with methanol at the output of stage (a);

(b) the gas exiting stage (a) is brought into contact with a mixture of solvents that comprises methanol, water, and a higher boiling solvent than methanol, with the gas exiting stage (b) thus being at least partially free of the acid gases that it initially contained in the process;

(c) at least a portion of the mixture of solvents that is obtained from stage (b) that is charged with acid gases is regenerated by pressure reduction and/or heating by releasing at least a portion of the acid gases, with the mixture of solvents that is at least partially regenerated being, at the end of stage (c), recycled to stage (b); and (d) the gas that is obtained from stage (b) is cooled sufficiently to produce at least one aqueous phase that contains methanol which is recycled at least in part to stage (a).

2. A process according to claim 1, wherein the solvent that boils higher than methanol that is incorporated into the mixture of solvents that is used during stage (b) has a boiling point that is greater than that of methanol and than that of water and is at least partially miscible with water and methanol.

3. A process according to claim 1, wherein the solvent that is higher boiling than methanol that is incorporated into the mixture of solvents that is used during stage (b) is a hydroxylated secondary or tertiary amine or a polar solvent.

4. A process according to claim 1, wherein in stage (a), the contact that is made between at least a portion of the gas to be treated and the aqueous phase that contains the methanol that is obtained from stage (d) is carried out countercurrently in a column, with the aqueous phase that is evacuated at the bottom of said column being largely free of methanol.

5. A process according to claim 1, wherein during stage (b), the gas that is obtained from stage (a) is brought into countercurrent contact in a contact column, successively with a fraction of the mixture of solvents that is relatively rich in methanol, which is sent to an intermediate point of the contact column, and then with a fraction of the mixture of solvents that is relatively low in methanol, which is sent to the top of the contact column.

6. A process according to claim 5, wherein the mixture of solvents that is obtained from stage (b) is regenerated by pressure reduction and then by heating countercurrently in a contact column, with the solvent phase that is removed at the bottom of said column forming the fraction of the mixture of solvents that is relatively low in methanol which is injected at the top of the contact column that is used during stage (b).

7. A process according to claim 1, wherein the mixture of solvents that is obtained from stage (b) undergoes a first stage of pressure reduction to an intermediate pressure for releasing at least a portion of coabsorbed hydrocarbons.

8. A process according to claim 7, wherein the gas fraction that is obtained from the pressure reduction to an intermediate pressure of the mixture of solvents coming from stage (b) is scrubbed by a fraction of the mixture of solvents that is relatively low in methanol collected at the bottom of the regeneration column that is used during stage (c).

9. A process according to claim 5, wherein the fraction of the mixture of solvents that is relatively rich in methanol, which is sent to an intermediate point of the contact column used during stage (b), is obtained by reducing the pressure of at least a fraction of the mixture of solvents coming from stage (b).

10. A process according to claim 5, wherein the fraction of the mixture of solvents that is relatively rich in methanol which is sent to an intermediate point of the contact column that is used during stage (b) is removed at an intermediate point of a regeneration column that is used during stage (c).

11. A process according to claim 1, wherein the mixture of solvents that is obtained from stage (b) is, after pressure reduction, sent to several levels of the regeneration column that is used during stage (c).

12. A process according to claim 1, wherein the fraction or fractions of the mixture of solvents obtained from a regeneration column that is used during stage (c) are cooled to a temperature that is close to the temperature at which stage (b) is carried out by heat exchange with the mixture of solvents coming from stage (b) and optionally by an additional heat exchange step, with a cooling fluid.

13. A process according to claim 1, wherein at least a portion of the mixture of solvents obtained from stage (b) is regenerated after pressure reduction, at least partially in a column of which at least a portion operates in simultaneous heat exchange with at least a portion of the regenerated mixture of solvents that is recycled to stage (b).

14. A process according to claim 1, wherein the acid gases released by pressure reduction and/or heating of the mixture of solvents that is obtained from stage (b) are washed by a flow of water that is obtained from stage (a) to recover at least a portion of the methanol that they contain, with the aqueous phase that contains the methanol that is thus obtained being recycled to stage (a).

15. A process according to claim 1, wherein the acid gases that are released by pressure reduction and/or heating of the mixture of solvents that is obtained from stage (b) are rectified at a temperature that is lower than the temperature at which stage (b) is carried out to free them of the methanol and the water that they contain.

16. A process according to claim 1, wherein stage (b) is carried out at a temperature of between +10° and +40° C.

17. A process according to claim 1, wherein during stage (d), the natural gas is refrigerated to a temperature of between 0° C. and −100° C., with the methanol content in the fraction of the mixture of solvents sent to the top of the contact column that is used during stage (b) being adjusted to obtain a methanol content, in the gas coming from stage (b), that makes it possible to keep hydrates from forming at the lowest temperature obtained during stage (c).

18. A process according to claim 1, wherein during stage (d), a liquid hydrocarbon fraction is separated from the treated gas, which is then brought by heat exchange to a temperature that is close to its initial temperature.

19. A process according to claim 1, wherein regeneration stage (c) comprises at least two successive regeneration operations, with a gas fraction that is rich in $CO_2$ being obtained at the end of the first operation and a fraction that is rich in $H_2S$ being obtained at the end of the second operation.

* * * * *